US011189202B1

(12) United States Patent
Chang et al.

(10) Patent No.: US 11,189,202 B1
(45) Date of Patent: Nov. 30, 2021

(54) SPATIALLY LEAKING TEMPORAL INTEGRATOR FOR PIXEL COMPENSATION

(71) Applicant: Apple Inc., Cupertino, CA (US)

(72) Inventors: Sun-Il Chang, San Jose, CA (US); Baris Cagdaser, Sunnyvale, CA (US); Chaohao Wang, Sunnyvale, CA (US); Derek Keith Shaeffer, Redwood City, CA (US); Hyunsoo Kim, Mountain View, CA (US); Hyunwoo Nho, Palo Alto, CA (US); Injae Hwang, Cupertino, CA (US); Jesse Aaron Richmond, San Francisco, CA (US); Jie Won Ryu, Santa Clara, CA (US); Junhua Tan, Saratoga, CA (US); Kingsuk Brahma, Mountain View, CA (US); Myung-Je Cho, San Jose, CA (US); Myungjoon Choi, Sunnyvale, CA (US); Shengkui Gao, San Jose, CA (US); Shiping Shen, Cupertino, CA (US); Wei H. Yao, Palo Alto, CA (US); Yunhui Hou, San Jose, CA (US)

(73) Assignee: Apple Inc., Cupertino, CA (US)

( * ) Notice: Subject to any disclaimer, the term of this patent is extended or adjusted under 35 U.S.C. 154(b) by 126 days.

(21) Appl. No.: 16/567,989

(22) Filed: Sep. 11, 2019

Related U.S. Application Data

(60) Provisional application No. 62/732,294, filed on Sep. 17, 2018.

(51) Int. Cl.

| | |
|---|---|
| ***G09G 3/00*** | (2006.01) |
| ***G09G 3/3258*** | (2016.01) |
| ***G09G 3/3233*** | (2016.01) |

(52) U.S. Cl.
CPC ..... *G09G 3/006* (2013.01); *G09G 3/3233* (2013.01); *G09G 3/3258* (2013.01); *G09G 2320/0214* (2013.01)

(58) Field of Classification Search
CPC ..... G09G 3/006
See application file for complete search history.

(56) References Cited

U.S. PATENT DOCUMENTS

| | | | | |
|---|---|---|---|---|
| 2005/0157791 | A1* | 7/2005 | Sun | H04N 19/61 375/240.16 |
| 2018/0005557 | A1* | 1/2018 | Chaji | G09G 3/006 |
| 2019/0266935 | A1* | 8/2019 | Roever | G09G 3/2051 |

* cited by examiner

*Primary Examiner* — Priyank J Shah
(74) *Attorney, Agent, or Firm* — Fletcher Yoder, P.C.

(57) ABSTRACT

A system may include an electronic display panel having multiple pixels for depicting image data and processing circuitry that may receive a first error value representative of a first difference between a first electrical signal measured at a first pixel of the multiple pixels and an expected electrical signal for the first pixel. The first electrical signal may be based on a test signal transmitted to the first pixel and the expected electrical signal may correspond to an expected response of the first pixel based on the test signal. The processing circuitry may filter the first error value to generate a first compensated error value and may filter the first error value based on the first compensated error value to generate a second compensated error value, where the second compensated error value may filter one or more effects of spatial crosstalk between one or more pixels near the first pixel.

16 Claims, 8 Drawing Sheets

SPATIALLY LEAKING TEMPORAL INTEGRATOR FOR PIXEL COMPENSATION

CROSS-REFERENCE TO RELATED APPLICATIONS

This application claims the benefit of U.S. Provisional Application No. 62/732,294, entitled "Spatially Leaking Temporal Integrator for Pixel Compensation," filed on Sep. 17, 2018, which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

To reduce or correct for these non-uniformities, pixel performance may be externally sensed and compensated. Methods and systems for reducing non-uniform properties of a display may include use of a non-uniformity correction system. A non-uniformity correction system may include sensing a parameter, comparing the measured parameter value to an expected measured parameter value to determine a measurement error, and performing measurement error correction techniques (e.g., to filter out influence from an undesired factor, such as temperature). However, measurement errors between sensing locations may influence measurement errors in nearby sensing locations exaggerated by an interaction between temporal integrating and spatial filtering used in some error correction techniques. Thus, systems and methods for reducing diffused measurement errors from temporal integrating and spatial filtering may provide immense value.

To elaborate, spatial filtering may occur over measurement areas and errors in spatial filtering associated with a measurement area may propagate into nearby measurement areas and introduce noise. This noise may be exaggerated during temporal integration and may not permit or delay convergence of a non-uniformity correction system (e.g., sequentially coupled spatial filter and temporal integrator) to a steady compensated error value (e.g., constant error value, zero).

For example, during a calibration period of a display, known test signals (e.g., voltage signal, current signal) are transmitted to pixels of the display. These test signals are to elicit an expected response, however, the signals may not cause the expected response due to the various sources of non-uniformities described earlier. Thus, a measurement error between a measured pixel parameter value (e.g., measured after the test signal is transmitted) and an expected pixel parameter value may be used to adjust display operation to compensate for detected non-uniformities in the display.

With the foregoing in mind, the detected error between the measured pixel parameter value and the expected pixel parameter value may be transmitted through a non-uniformity correction system. For example, a measurement error may undergo temporal integration and spatial filtering prior to facilitate error correction operations. Spatial filtering may be a method for improving signal-to-noise ratios (SNRs) through averaging sensing data and/or calculated measurement errors over space (e.g., a display space defined through multiple sensing areas, for example, in a grid or regular design). Temporal filtering may be a method for improving SNRs through averaging or integrating sensing data and/or calculated error over time (e.g., between different image frames). Spatial filtering operations and temporal integration operations may be sequentially performed, where the measurement error undergoes spatial filtering before undergoing temporal integration.

This sequential processing may cause measurement errors to be inaccurate because additional errors may be introduced into the error measurement across a region during spatial filtering operations and exaggerated over time by performing the temporal integration operations. This phenome is also referred to as spatial crosstalk. Because the sequential processing relies on previously measured values to perform the correction (e.g., hysteresis), the spatial filtering operations and the temporal integration operations may cause slow convergence and control loop instability, which may lengthen a time used to perform the correction (e.g., while a processor waits for the compensated error value to converge). In addition, this arrangement may lead to an unstable system at high spatial frequencies since the non-uniformity correction system that behaves like an infinite impulse response (IIR) system at both low and high spatial frequencies due to the feedback of the measured values. An IIR system that is inherently unstable does not settle to a constant value over time like a stable system might, and thus the non-uniformity correction system may become unstable over time.

Keeping this in mind, the present disclosure describes an electronic display that performs the spatial filtering and the temporal integration operations within a same feedback loop by leveraging an embedded spatial filter as a component of a spatially leaking temporal integrator. Thus, the spatial crosstalk described above may be negated, reduced, or eliminated if the spatial filtering and the temporal integration operations are performed within the same integration feedback loop, as compared to using the spatial filtering output as an integrating feedback loop input to perform the temporal filtering and integration. In this way, when the spatial filter uses the same previous compensated error as the temporal integration, additional errors propagated to nearby pixels may not be exaggerated over time via temporal integration. As a result, the hysteresis effect and spatial crosstalk may be reduced, and the non-uniformity correction system output may converge to a final compensated error value more efficiently and/or faster than when spatial filtering and temporal integration are sequentially performed.

In addition, these methods and systems for compensating for non-uniformities between pixels of an electronic display may improve the visual appearance of an electronic display by reducing perceivable visual artifacts. The systems to perform the compensation, error measurement, and/or error processing may be inside or outside of an electronic display and/or an active area of the electronic display, and thus may provide a form of internal or external compensation. The compensation may take place in a digital domain or an analog domain, and the net result may produce an adjusted electrical signal that may be transmitted to each pixel of the electronic display before the electrical signal is used to cause the pixel to emit light. Because the adjusted electrical signal has been compensated to account for the non-uniformities of the pixels caused by additional error propagation during non-uniformity correction operations, the images resulting from the electrical signals to the pixels may substantially reduce or eliminate visual artifacts and increase uniformity across the electronic display.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
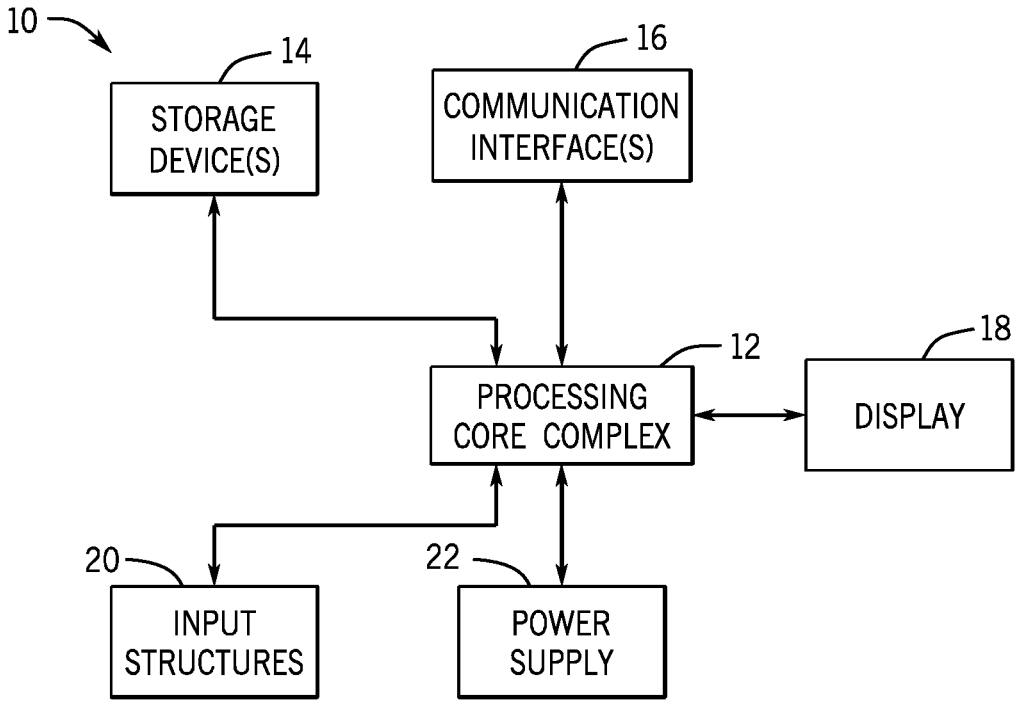
FIG. 1 is a schematic block diagram of an electronic device, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates generally to techniques for improving error correction operations associated with pixels of an electronic display. Electronic di splays are found in numerous electronic devices, from mobile phones to computers, televisions, automobile dashboards, and many more. Individual pixels of the electronic display may collectively produce images by permitting different amounts of light to be emitted from each pixel. This may occur by self-emission as in the case of light-emitting diodes (LEDs), such as organic light-emitting diodes (OLEDs), or by selectively providing light from another light source as in the case of a digital micromirror device or liquid crystal display. These electronic displays sometimes do not emit light equally between portions or between pixels of the electronic display, for example, due at least in part to pixel non-uniformity caused by differences in component age, operating temperatures, material properties of pixel components, and the like. Moreover, in some cases, pixel non-uniformity is also caused by noise or interference introduced into signals transmitted to the pixel to display an image, for example, distortions caused by travel through space or time, distortion caused by image data being transmitted to adjacent pixels, or the like. The non-uniformity between pixels and/or portions of the electronic display may manifest as visual artifacts due to different pixels or areas of the electronic display emitting visibly different amounts of light. Thus, embodiments of the present disclosure relate to error correction techniques for use in non-uniformity correction operations.

To use these techniques, in one embodiment, a controller may measure a pixel parameter, such as voltage, current, temperature, or the like, as a part of a calibration activity that uses test signals to test or verify pixel performance. This pixel parameter may be any suitable value indicative of pixel performance, for example, a data voltage, a frequency of a control signal used to perform switching, a threshold voltage of a light-emitting diode (LED), a threshold voltage of a transistor associated with the pixel, or the like. Generally, the pixel parameter may be adjusted to facilitate uniform display of an image. The pixel parameter may be adjusted based on a difference between a measured pixel parameter value in response to a test signal and an expected pixel parameter value for the test signal. The difference may be used to determine a measurement error, which is to be processed to account for noise and sensed value errors associated with determining the measurement error and/or measuring the pixel parameter. The processing may include transmitting the measurement error as an input for spatial filtering operations and then transmitting the filtered measurement error as an input for temporal integration operations. In this way, a pixel disposed in a location far from an originating location of electrical signals corresponding to image data (e.g., a display component responsible at least in part for generating driving currents or voltages corresponding to an image to be presented) may display the same electrical signal differently than a pixel disposed closer to the originating location of the electrical signals due to noise and distortions introduced into the electrical signals through transmission. Similarly, a particular measurement may be distorted due to similar transmission distortions.

In some embodiments, to correct for the distortion of the measurement error, a controller may determine a residual error (e.g., a first residual error) indicative of the change over time (e.g., a change over two error correction operations) between the measurement error (e.g., measured at time t) and a most recent previous compensated error (e.g., originating from a measurement error previously measured at time t−1). After determining the residual error, as described herein, instead of sequentially performing the spatial filtering and then the temporal integration, the controller may add the most recent previous compensated error back to the residual error to generate the input (e.g., a second residual error) for a temporal integrator (e.g., temporal integration operations) with an embedded spatial filter (e.g., embedded spatial filtering operations). In this way, the controller may input the residual error (based on the measurement error) to a spatially leaking temporal integrator (e.g., a temporal filtering integrator with an embedded spatial filter and a feedback loop) to determine a compensated error associated with the pixel parameter and the individual response of a pixel to a test signal. The controller may save the compensated error output, along with an indication of a time recorded or of the time of measurement. The controller may then transmit the compensated error output to be used in a subsequent calculations or adjustments.

A controller operating in the way described above may enable a non-uniformity correction system to operate at a stable state at low spatial frequencies as well as high spatial frequencies. A general description of suitable electronic devices that uses non-uniformity correction operations to calibrate and compensate for non-uniform pixel properties, and that display images through emission of light from light-emitting components, such as a LED (e.g., an OLED) display, and corresponding circuitry are provided in this disclosure. It should be understood that a variety of electronic devices, electronic displays, and electronic display technologies may be used to implement the techniques described here.

One example of a suitable electronic device is shown in FIG. 1 (e.g., electronic device 10) and may include, among other things, processor(s) such as a system on a chip (SoC) and/or processing core complex 12, storage device(s) 14, communication interface(s) 16, a display 18, input structures 20, and a power supply 22. The blocks shown in FIG. 1 may each represent hardware, software, or a combination of both hardware and software. The electronic device 10 may include more or fewer elements. It should be appreciated that FIG. 1 merely provides one example of a particular implementation of the electronic device 10.

The processing core complex 12 of the electronic device 10 may perform various data processing operations, including generating and/or processing image data for presentation on the display 18 such as in coordination with a controller of the display 18 to perform measurement error correction operations and/or non-uniformity correction operations, in combination with the storage devices 14. For example, instructions that are executed by the processing core complex 12 may be stored on the storage devices 14. The storage devices 14 may include volatile and/or non-volatile memory. By way of example, the storage devices 14 may include random-access memory (RAM), read-only memory (ROM), flash memory, a hard drive, and so forth.

The electronic device 10 may use the communication interfaces 16 to communicate with various other electronic devices or elements. The communication interface 16 may include input/output (I/O) interfaces and/or network interfaces. Such network interfaces may include those for a personal area network (PAN) such as Bluetooth, a local area network (LAN), a wireless local area network (WLAN) such as Wi-Fi, and/or a wide area network (WAN) such as a cellular network.

Using pixels containing LEDs (e.g., OLEDs), the display 18 may show images generated by the processing core complex 12. The display 18 may include touchscreen functionality for users to interact with a user interface appearing on the display 18. Input structures 20 may also enable a user to interact with the electronic device 10. In some examples, the input structures 20 may represent hardware buttons, which may include volume buttons or a hardware keypad. The power supply 22 may include any suitable source of power for the electronic device 10. This may include a battery within the electronic device 10 and/or a power conversion device to accept alternating current (AC) power from a power outlet.

Figure 2:
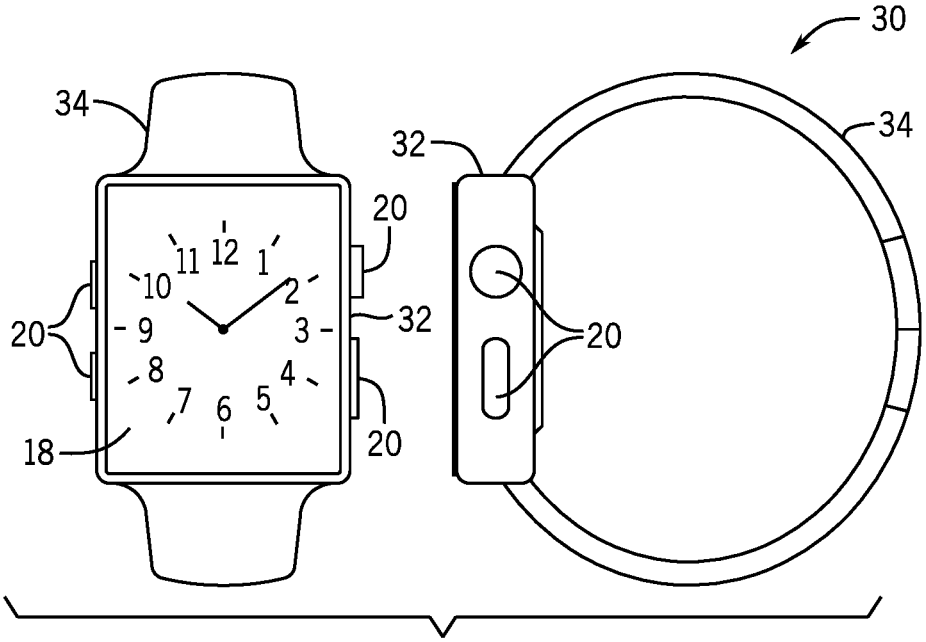
FIG. 2 is a perspective view of a fitness band representing an embodiment of the electronic device of FIG. 1, in accordance with an embodiment.

As may be appreciated, the electronic device 10 may take a number of different forms. FIG. 2 is a perspective view of an embodiment of the electronic device 10, a watch 30. For illustrative purposes, the watch 30 may be any Apple Watch® model available from Apple Inc. The watch 30 may include an enclosure 32 that houses the electronic device 10 elements of the watch 30. A strap 34 may enable the watch 30 to be worn on the arm or wrist. The display 18 may display information related to operation of the watch 30, such as the time. Input structures 20 may enable a person wearing the watch 30 navigate a graphical user interface (GUI) on the display 18.

Figure 3:
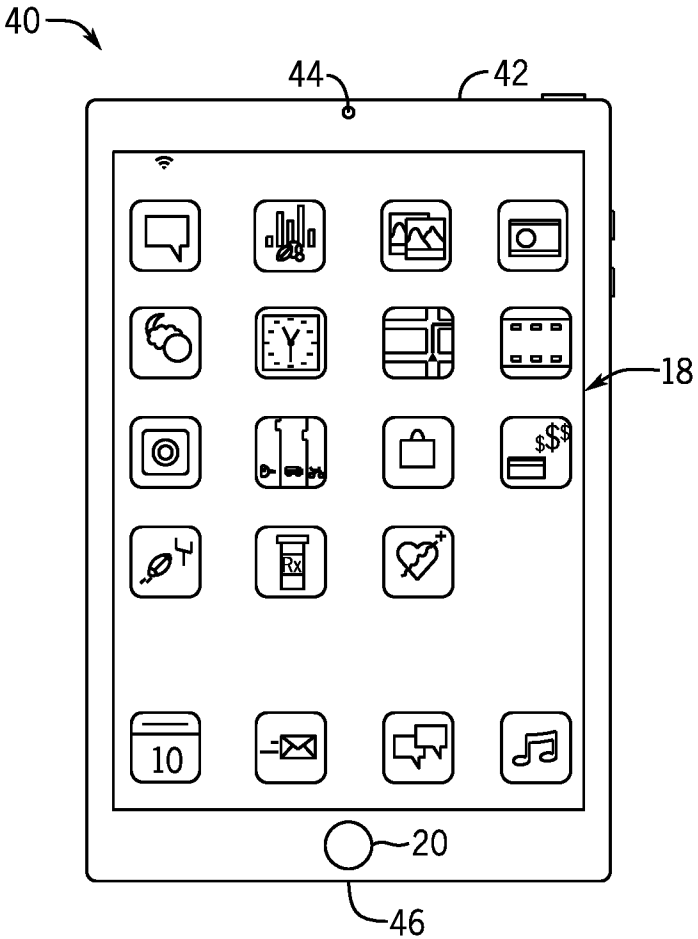
FIG. 3 is a front view of a slate representing an embodiment of the electronic device of FIG. 1, in accordance with an embodiment.

The electronic device 10 may also take the form of a tablet device 40. FIG. 3 is a front view of an example tablet device 40. For illustrative purposes, the tablet device 40 may be any iPad® model available from Apple Inc. Depending on the size of the tablet device 40, the tablet device 40 may serve as a handheld device such as a mobile phone. The tablet device 40 includes an enclosure 42 through which input structures 20 may protrude. In certain examples, the input structures 20 may include a hardware keypad (not shown). The enclosure 42 also holds the display 18. The input structures 20 may enable a user to interact with a GUI of the tablet device 40. For example, the input structures 20 may enable a user to type Short Message Service (SMS) text messages, Rich Communication Service (RCS) text messages, or make a telephone call. A speaker 44 may output a received audio signal and a microphone 46 may capture the voice of the user. The tablet device 40 may also include a communication interface 16 to enable the tablet device 40 to connect via a wired connection to another electronic device.

Figure 4:
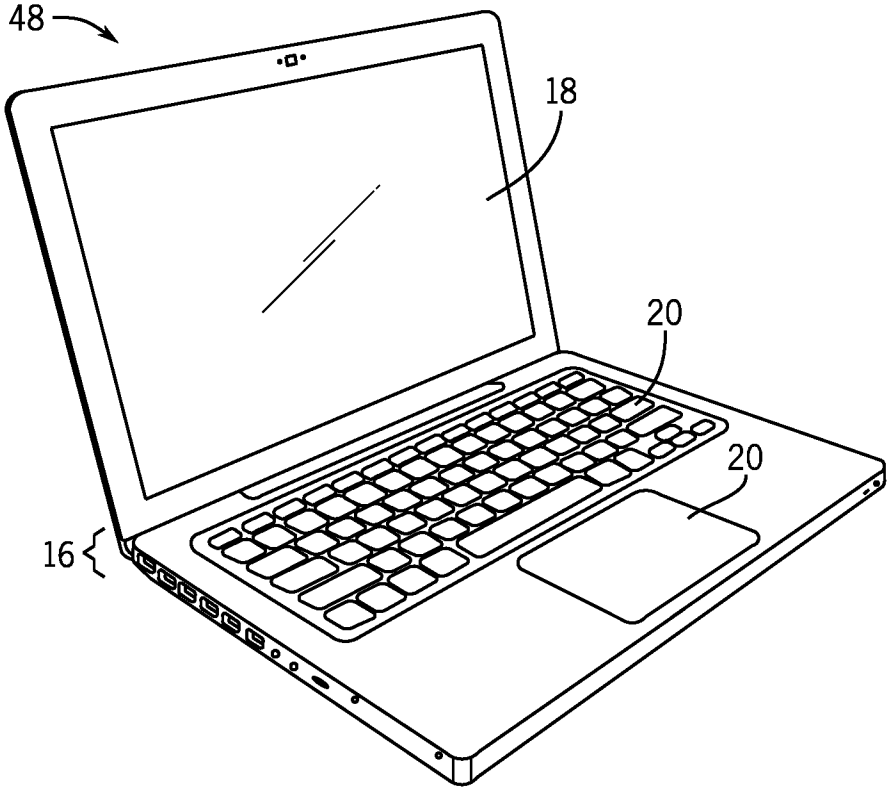
FIG. 4 is a front view of a notebook computer representing an embodiment of the electronic device of FIG. 1, in accordance with an embodiment.

FIG. 4 is a front view of a third embodiment of the electronic device 10, a computer 48. For illustrative purposes, the tablet device 40 may be any MacBook® model available from Apple Inc. It should be appreciated that the electronic device 10 may also take the form of any other computer, including a desktop computer. The computer 48 shown in FIG. 4 includes the display 18 and the input structures 20 that include a keyboard and a track pad. Communication interfaces 16 of the notebook computer 48 may include, for example, a universal service bus (USB) connection.

Figure 5:
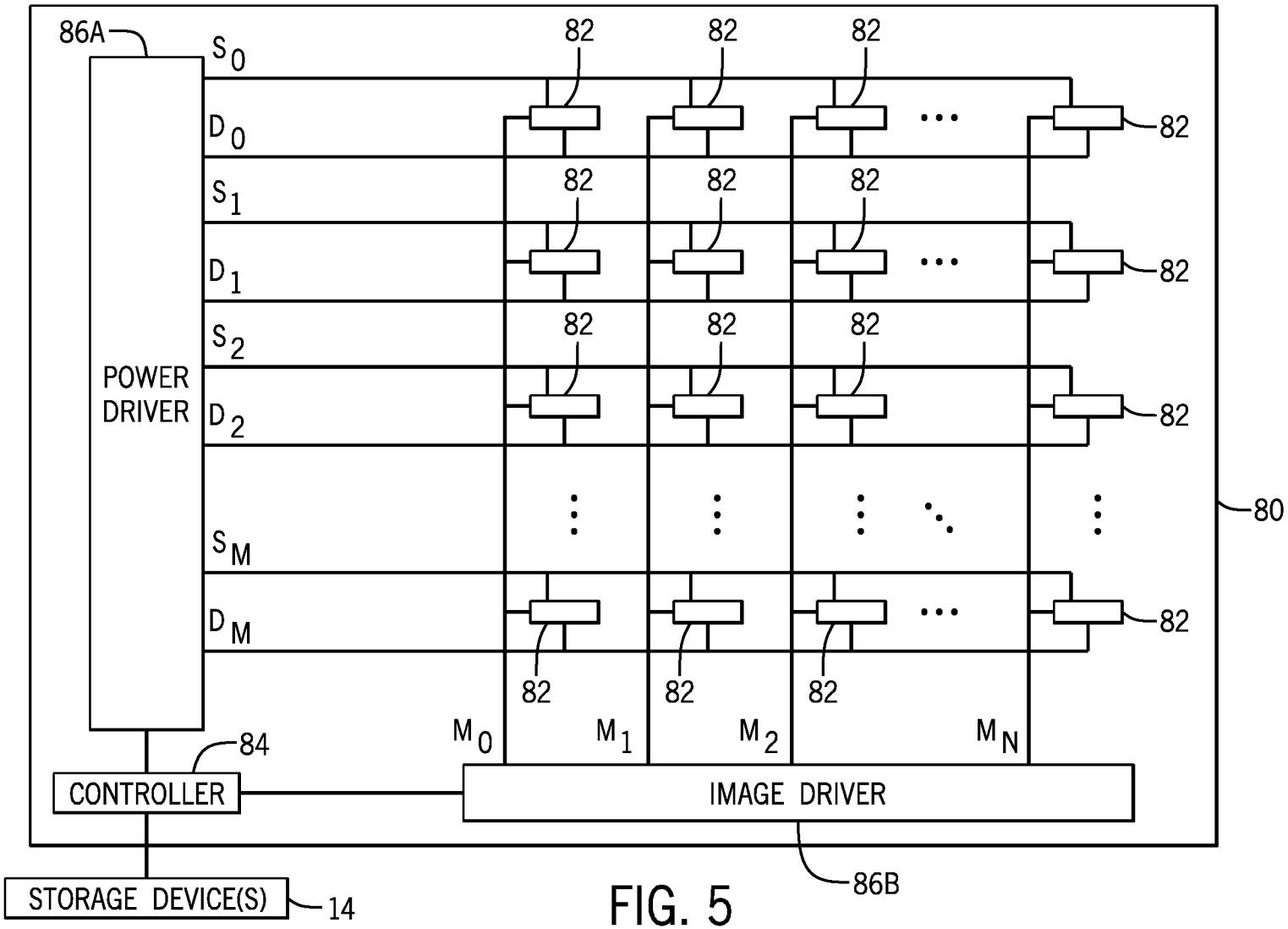
FIG. 5 is a circuit diagram of the display of the electronic device of FIG. 1, in accordance with an embodiment.

Each of these embodiments of the electronic device 10 may include a pixel array. FIG. 5 is a block diagram of an example electronic display panel including a pixel array 80 having one or more pixels 82. The display 18 may include any suitable circuitry to drive the pixels 82 (e.g., driving circuitry). In the example of FIG. 5, the display 18 includes a controller 84, a power driver 86A, an image driver 86B, and the array of the pixel 82. The power driver 86A and image driver 86B may drive individual pixels 82. In some embodiments, the power driver 86A and the image driver 86B may include multiple channels for independently driving multiple pixels 82. Each pixel 82 may include any suitable light-emitting element, such as a LED, one example of which is an OLED. However, any other suitable type of pixel, including, for example, liquid crystal, digital micromirror pixels may also be used. In addition, in some embodiments, sensing circuitry may be included in the power driver 86A and/or the image driver 86B to measure pixel parameters or perform pixel parameter adjustments (e.g., adjustment of control signals transmitted to one or more pixels 82) as part of non-uniformity correction operations and/or error correction operations. However, it should be appreciated that this sensing circuitry may also be disposed external and/or the pixel parameter adjustments performed external, such as in an externally disposed processing core complex 12, to the power driver 86A and/or the image driver 86B to perform external compensation operations.

The scan lines S0, S1, . . . , and Sm and driving lines D0, D1, . . . , and Dm may connect the power driver 86A to the pixel 82. The pixel 82 may receive on/off instructions through the scan lines S0, S1, . . . , and Sm and may generate programming voltages corresponding to data voltages transmitted from the driving lines D0, D1, . . . , and Dm. The programming voltages may transmit to each pixel 82 to emit light according to instructions from the image driver 86B through driving lines M0, M1, and Mn. Both the power driver 86A and the image driver 86B may transmit voltage signals at programmed voltages through respective driving lines to operate each pixel 82 at a state determined by the controller 84 to emit light. Each driver may supply voltage signals at a duty cycle and/or an amplitude sufficient to operate each pixel 82.

The intensities of each pixel 82 may be defined by corresponding image data. In this way, a first brightness of light may emit from a pixel 82 in response to a first value of the image data and the pixel 82 may emit a second brightness of light in response to a second value of the image data. Thus, image data may create a perceivable image output through indicating light intensities to apply to individual pixels 82 via generated electrical signals.

The controller 84 may retrieve image data stored in the storage devices 14 indicative of light intensities for the colored light outputs for the pixels 82. In some embodiments, the processing core complex 12 may provide image data directly to the controller 84 that may have been adjusted based on a compensated error value determined through error correction operations, such as to adjust driving electrical signals to compensate for non-uniform display 18 properties as part of non-uniformity correction operations and/or the controller 84 may operate the drivers 86 to perform the adjustments. In this way, the controller 84 may facilitate a control loop associated with correction operations (e.g., a measurement system that works with sensing circuitry to measure one or more pixel parameters for use in determining a measurement error) to adjust pixel parameters in response to measurement errors and/or compensated error values. The controller 84 may control the pixel 82 by using control signals to control particular controllable elements of the pixel 82.

The pixel 82 may include any suitable controllable element, such as a transistor, one example of which is a metal-oxide-semiconductor field-effect transistor (MOSFET). In some embodiments, the driving circuitry of the pixel 82 includes one or more transistors responsive to electrical signals transmitted by the controller 84 to cause light transmission at a particular gray level. It should be understood that any other suitable type of controllable elements, including thin film transistors (TFTs), p-type and/or n-type MOSFETs, and other transistor types, may also be used.

Figure 6A:
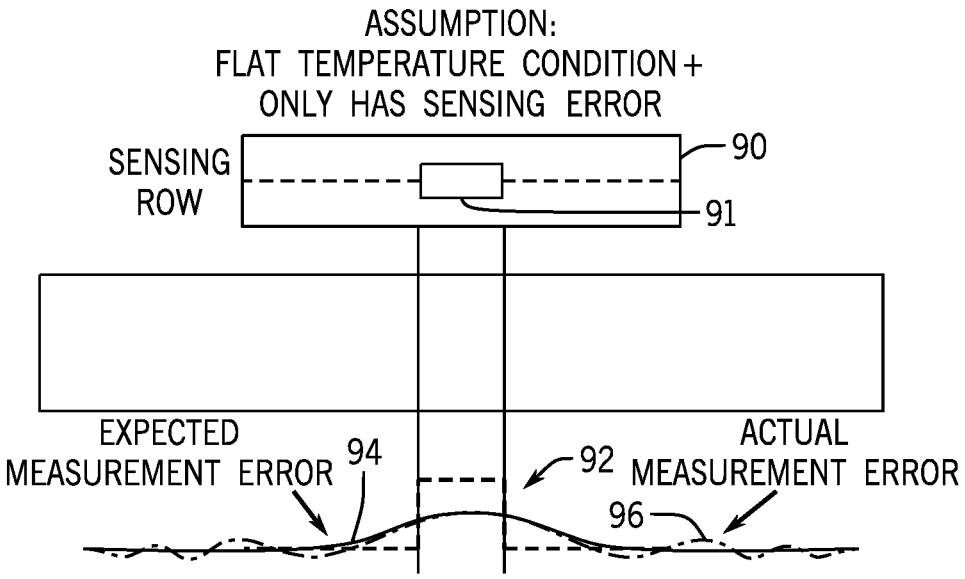
FIG. 6A is a diagrammatic representation depicting measurement errors associated with non-uniformity correction operations, in accordance with an embodiment.

FIG. 6A is a diagrammatic representation illustrating the effects of spatial crosstalk associated with non-uniformity correction operations simulated with constant temperature conditions. The non-uniformity correction operations include measuring a pixel parameter (e.g., voltage, current) associated with a pixel 82 within a sensing row 90 in response to receiving electrical signals corresponding to test image data to display, where the sensing row 90 corresponds a row of horizontally situated sensing locations that are individually sensed for non-uniformity correction operations. As depicted, the sensing row 90 includes a sensing location 91 (e.g., including one or more pixels 82, not depicted) to be used with the sensing operations. Based on a difference between the measured pixel parameter and an expected pixel parameter, a measurement error is determined. This measurement error undergoes spatial filtering and then temporal integration to determine a compensated error used in additional calculations or adjustments to correct for non-uniform properties of a display 18.

As shown in inset graph 92, a particular sensing operation, represented by line 94, may have the highest amount of measurement error at the sensing location 91, with the amount of measurement error steadily decreasing in both directions of the sensing row 90 from the sensing location 91. However, in the actual case, the particular sensing operation, represented by line 96, may actually have the highest amount of measurement error centered at the sensing location 91 and the amount of measurement error may oscillate away from the sensing location 91 toward other nearby sensing locations included (not depicted) within the sensing row 90. In other words, factors causing the measurement error at one sensing location 91 may propagate to nearby sensing locations 91. For example, measured and/or transmitted signals to the sensing location 91 may cause interference to signals measured and/or transmitted to other nearby sensing locations 91, thereby affecting sensing operations for the other nearby sensing locations (e.g., nearby pixels 82, not depicted). One example of this is spatial crosstalk, as discussed above.

Figure 6B:
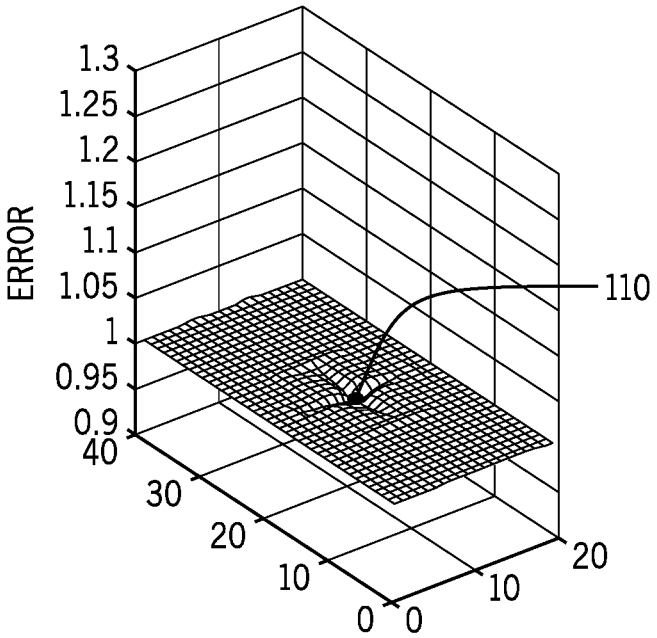
FIG. 6B is a graph depicting spatial crosstalk between sensing locations associated with non-uniformity correction operations, in accordance with an embodiment.

FIG. 6B is a graph showing an effect of spatial crosstalk on adjacent sensing locations 91. A point 110 on the graph corresponds to the sensing location 91. The point 110 also represents a particular amount of measurement error, where the depicted measurement error may include additional error caused at least in part by pixels 82 of the sensing location 91 receiving signals resulting from driving separate pixels 82 of a separate sensing location 91 at the same time. The measurement error is propagated in various directions away from the point 110, due to the pixel parameter being applied to the pixels 82 of the sensing location 91 and the resulting spatial crosstalk. The propagation of measurement error may be caused at least in part by the spatial crosstalk complicating error compensation since the effect of a test signal to pixels 82 of a sensing location 91 may influence non-uniformity compensation of nearby sensing locations 91. Thus, a process to minimize the spatial crosstalk may include performing the spatial filtering before the temporal integration. As is depicted in FIG. 7 and FIG. 8, the process includes embedding spatial filtering operations with temporal integrating operations to facilitate decoupling the interaction between the operations at least in part responsible for the spatial crosstalk.

Figure 7:
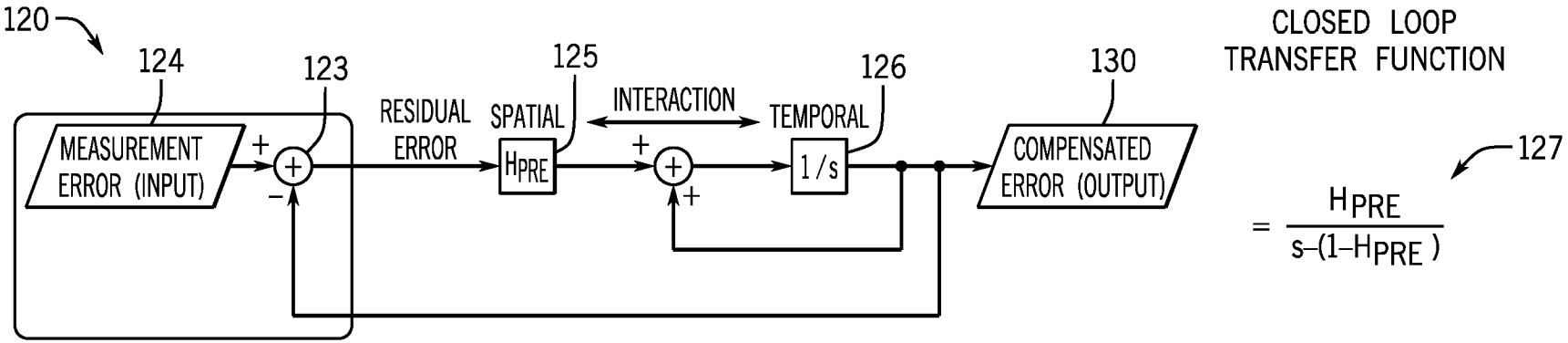
FIG. 7 is a diagrammatic representation of a control flow diagram depicting a sequentially coupled spatial filter and temporal integrator used in sequential non-uniformity correction operations, in accordance with an embodiment.
Figure 8:
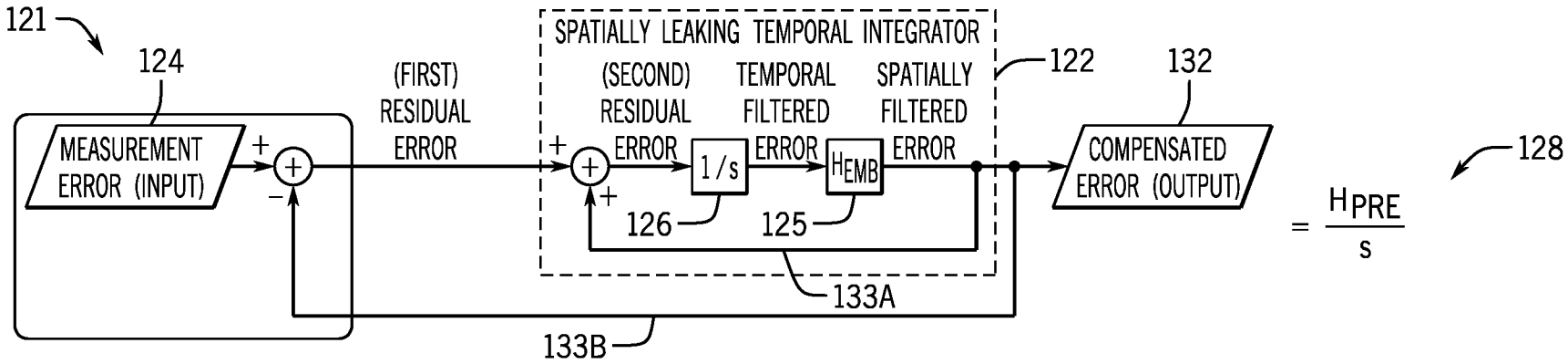
FIG. 8 is a diagrammatic representation of a control flow diagram depicting a spatially leaking temporal integrator with an embedded spatial filter used in non-uniformity correction operations, in accordance with an embodiment.

FIG. 7 is a diagrammatic representation of an example control flow diagram 120 depicting a sequentially coupled spatial filter and temporal integrator. FIG. 8 is a diagrammatic representation of an example control flow diagram 121 depicting a spatially leaking temporal integrator 122. Both diagram 120 and diagram 121 may represent circuitry used for error correction operations of non-uniformity correction operations, and since the diagram 121 represents an improved version of the diagram 120, both FIG. 7 and FIG. 8 are discussed in parallel below. It should be understood that the control blocks of the diagram 120 and the diagram 121 represent operational functions that may be performed by a controller to complete the depicted tasks. For example, a controller programmed to perform a summation executes the summation at summation node 123. In the diagram 120, a measurement error input 124, such as the determined measurement error associated with a deviation of a measured pixel parameter value from an expected value in response to one or more test signals that are expected to generate the expected value of the pixel parameter, undergoes spatial filtering and then temporal integration before being used in error corrections. This measurement system may not converge to a stable compensated error value, for example, due to the spatial crosstalk effects that occurs due to measurement error propagation between the spatial filtering operations (e.g., spatial filter 125) and the temporal integration operations (e.g., temporal filter 126), as described above.

To elaborate, the non-uniformity correction system represented by the diagram 120 may not operate as a finite impulse response (FIR) system and instead may operate as an infinite impulse response (IIR) system. A FIR system may settle in response to an impulse signal transmitted into the control loop while an IIR system may not settle over time in response to the same impulse signal. In this way, a controller using an IIR system (e.g., diagram 120) to perform the error correction may cause continual error correction since the value may not converge.

The ability of a system to settle, or converge, over time is related at least in part to the overall system stability. In the diagram 120, the corresponding closed loop transfer function 127 has an eigenvalue of $+(1-H_{pre})$. Since the $H_{pre}$ value is constant associated with the spatial filtering, this eigenvalue is not adjustable to make the system stable, and thus at high frequencies (e.g., temporal frequencies, spatial frequencies) the system is stable but at low frequencies the system is unstable. In instances, like this, where operations used within the control loops are unable to be changed (e.g., adjust eigenvalues to promote system stability), designing a system to be inherently stable is desired.

When the spatial filtering is performed within the same inner control loop as the temporal integration, as shown in the diagram 121, the measurement system may become more stable when compared to the measurement system of the diagram 120 and converge to a stable compensated error value over time. The control flow of diagram 121 corresponds to a closed loop transfer function 128 that has an eigenvalue of 0, and thus is stable at both low and high frequencies. Because the measurement system associated with the diagram 121 is stable, compensated error output 132 value may converge over time for use in error correction, thus may be used to minimize spatial crosstalk effects on error correction operations. Thus, a non-uniformity correction system based on the diagram 121 may enable the compensated error output 132 to settle over time to a constant value, such as zero, as opposed to the compensated error output 130 from an IIR system that may not settle over time to a constant value due to system instabilities.

It should be noted that feedback path 133A and feedback path 133B used to transmit the compensated error for subtraction and addition with the measurement error input 124 may enable the IIR system behaviors to be cancelled to create a stable system. Thus, using a FIR system, or a system that is designed to behave like a FIR system, may improve error correction techniques because a FIR system may permit compensated error values associated with pixel operation to converge to a constant value over time.

In view of the discussion above, it should be noted that some embodiments of correction control loops may include additional corrections or processing that may change the value of the eigenvalues to values different from those listed above. It should also be appreciated that although particular components are not depicted, the control flow diagram 120 and/or the control flow diagram 121 may be implemented by one or more software and/or hardware components in a variety of suitable locations or components. For example, a main processor (e.g., processing core complex 12) and/or a local processor (e.g., controller 84) to a display 18 may host circuitry to provide a spatially leaking temporal integrator 122 for error correction operations. In addition, spatially leaking temporal integrator 122 circuitry may be located within the display 18 or may be located external to the display 18. Furthermore, some or all of the error correction operations may be cooperative with operation of a display pipe, that is, associated with a processor responsible for processing and queuing one or more image frames for future display. This display pipe may be located within the display 18 or external to the display 18, or any combination thereof.

Figure 9:
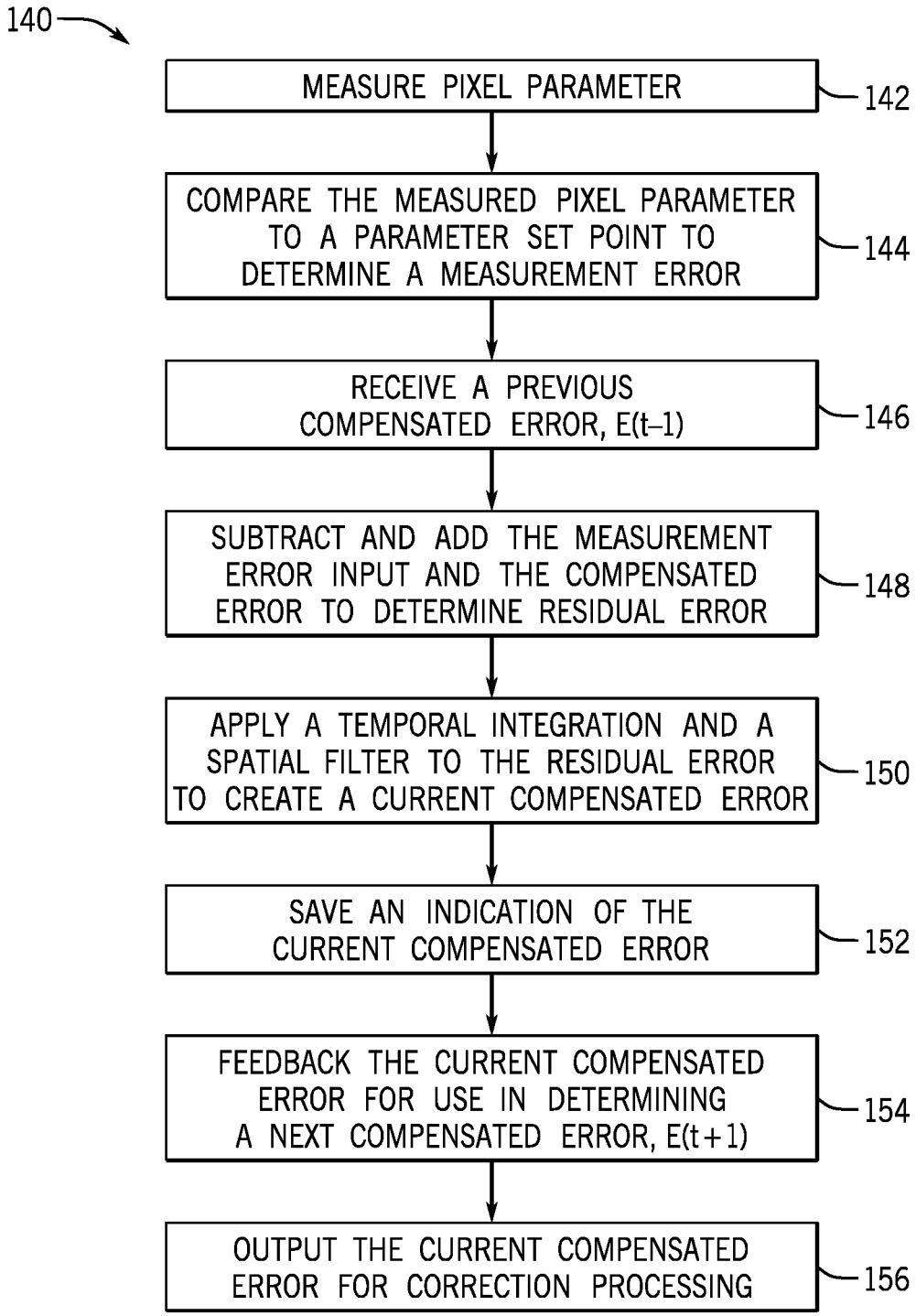
FIG. 9 is flow chart of a method for determining measurement error and generating a compensated error for use in non-uniformity correction operations, in accordance with an embodiment.

To elaborate on using circuitry described with the diagram 121, FIG. 9 is an example flow chart for a method 140 for measuring measurement error associated with a pixel parameter measurement and for determining a compensated error for use in the correction processing. Although the following description of the method 140 is described as being performed by the controller 84, it should be understood that any suitable processing-type device may perform, or facilitate performing, the method 140. For example, one or more processors located in either of the drivers 86 or located external to the display 18 may be used wholly or partially in performing the method 140. In this way, a combination of processing components may perform the method 140. Also, it should be understood that the method 140 may not be limited to being performed according to the order depicted in FIG. 8; and instead may be performed in any suitable order.

Referring now to FIG. 9, at block 142, the controller 84 may measure a pixel parameter. The pixel parameter may be any suitable value that is used to determine a corresponding amount of measurement error associated with sensing operations. In this way, the pixel parameter may be a voltage, a current, or the like and may be measured using any suitable means, for example, indirect sensing techniques, direct sensing techniques, or the like.

At block 144, the controller 84 may compare the measured pixel parameter to a parameter set point to determine a measurement error input 124. The parameter set point may be a value indicative of a desired operating value of the pixel parameter. For example, if the pixel parameter is a voltage, the measured pixel parameter value may be compared to a voltage set point indicative of a desired operation. This comparison may be performed through any suitable hardware or software means.

At block 146, the controller 84 receives a previous compensated error, E(t−1). In some embodiments, the controller 84 may retrieve the previous compensated error from a storage device 14 or other suitable memory. The previous compensated error represents a previous correction value output that resulted from a most recently performed correction operation, and, implicitly, a most recently used correction used in correction of a previous pixel parameter. The controller 84 may receive the previous compensated error and temporality store the value in memory, such as a volatile memory, to maintain access to the data.

After receiving the previous compensated error, the controller 84, at block 148, may subtract the measurement error input 124 and the previous compensated error to determine a first residual error, and may add the first residual error to the previous compensated error to determine a second residual error. This action occurs at the summation nodes (e.g., summation node 123) diagrammed within the diagram 121. Referring back to FIG. 7, in the diagram 121, the two feedback paths help provide stability to the measurement system. The controller 84, after subtracting the previous compensated error from the measurement error input 124, determines a residual error amount indicative of current operation. After adding the second residual error to the previous compensated error, the controller 84 may generate an adjusted error for use in determining the current compensated error.

At block 150, the controller 84 applies temporal integration and an embedded spatial filter (e.g., a spatially leaking temporal integrator 122 including temporal filter 126, spatial filter 125, and feedback path 133A) to the second residual error to create a current compensated error, E(t). The temporal integration and embedded spatial filter may be any suitable correction that is applied to each pixel, or each sensing grid in the case of multiple pixels to correct for pixel hysteresis, signal distortion due to spatial crosstalk, signal distortions due to transmission through time, signal distortions due to transmission through space, or the like. Performing the spatial filtering using the second residual error instead of the first residual error (e.g., the difference between the measurement error input 124 and the previous compensated error) facilitates stabilizing the measurement system such that a final compensated error is able to converge to a stable value over multiple corrections and/or over time.

After applying the spatially leaking temporal integrator, at block 152, the controller 84 saves an indication of the current compensated error determined at block 150 to memory or the storage device 14 for future reference. As shown at block 146, the current compensated error is referenced as a previous compensated error in future correction determinations, in this way saving this value facilitates future determinations. In addition, the indication of the current compensated error may be used to determine if the value of the current compensated error converged to a substantially constant value (e.g., zero). It may be desirable to wait to transmit electrical signals corresponding to image data (e.g., not testing signals) to the pixel 82 until the current compensated error converges to a constant error value. Waiting for the current compensated error to converge to a constant amount over time, and permitting multiple iterations of spatial and temporal filtering to occur, may reduce the chance of an unsuitable over- or under-correction occurring.

At block 154, the controller 84 may output the current compensated error for use in a next determination of a compensated error. The controller 84 may output a converged current compensated error or a non-converged compensated error based on the number of iterations of the method 140 have been performed and based on specifics of the measurement system (e.g., specifics that define characteristics of the transfer function indicative of the measurement system). If the measurement system has not been given enough time, or repeated enough times, to have the current compensated error converge to a substantially constant value, the controller 84 may output a non-converged value as the current compensated error. However, if the current compensated error has converged, the controller 84 outputs a converged value as the current compensated error.

At block 156, the controller 84 may output the current compensated error for correction processing of the pixel parameter. The outputting may occur before, during, or after the current compensated error converges to a substantially constant value, as described above. The current compensated error may be used in correction processing of the pixel parameter. Using the current compensated error in pixel parameter adjustments may improve adjustment techniques because the current compensated error represents the compensated error of the pixel parameter measurement, that is, the error value without additional influences affecting the value of the measurement error input 124. This may lead to more accurate pixel parameter adjustments, and ultimately an improved image quality on the display 18.

Figure 10:
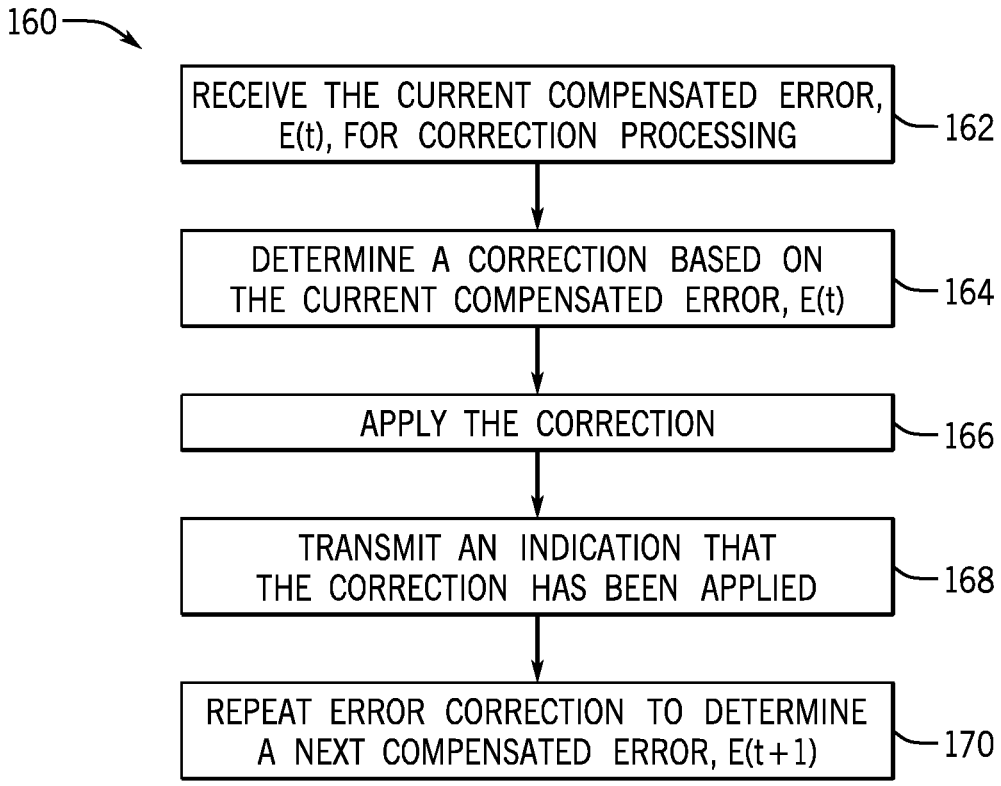
FIG. 10 is a flow chart of a method for determining an adjustment to a pixel parameter or a pixel operation as part of non-uniformity correction operations, in accordance with an embodiment.

To help describe the correction processing of the pixel parameter, FIG. 10 is a flow chart for a method 160 for correcting a pixel parameter based on a compensated error or current compensated error determined using the method 140. Although the following description of the method 160 is described as being performed by the controller 84, it should be understood that any suitable processing-type device may perform, or facilitate performing, the method 160. In this way, a combination of processing components may perform the method 160. Also, it should be understood that the method 160 may not be limited to being performed according to the order depicted in FIG. 10; and instead may be performed in any suitable order.

Referring now to FIG. 10, at block 162, the controller 84 may receive the current compensated error, E(t), output at block 156, for correction processing. In some embodiments, the controller 84 may retrieve the current compensated error from a memory or storage device 14 for use in correction processing. The current compensated error may indicate a compensated error associated with the pixel parameter measurement substantially void of additional influences and/or factors changing the value of the measurement error input 124. For example, an measurement error input 124 may change by a particular amount due to where the pixel 82 measured is located on the display 18, thus an additional adjustment may be used normalize or reduce the influence of the location of the pixel 82 on the measurement error input 124 (e.g., measured at the block 144) and facilitate providing a compensated error value.

At block 164, the controller 84 may determine a correction (e.g., adjustment) based on the current compensated error, E(t). This correction may correspond to an amount or a type of adjustment to apply to the pixel parameter (e.g., measured at block 142) to fix, or correct, differences between the pixel parameter and the desired pixel parameter set point based on the compensated error determined through the method 140. In this way, the adjustment to the pixel parameter is determined based at least in part on the determined compensated error (e.g., output at block 156), the measured pixel parameter (e.g., measured at block 142), and the desired pixel parameter. The correction may be any suitable control signal or data transmitted to the pixel 82, or any suitable control action. For example, a controller 84 may change a gray level the pixel 82 emits, change a frequency of enabling one or more control signals, change one or more voltages transmitted to the pixel 82, change one or more currents transmitted to the pixel 82, or the like. In addition, the correction may be based at least in part on additional information, such as data stored in a look-up table, a current-voltage (I-V) curve indicative of the response (e.g., generated voltage) of driving circuitry of a pixel 82 to a current input, or the like.

After determining the correction, at block 166, the controller 84 may apply or perform the correction determined at block 164. The controller 84 may apply the correction by changing states or signal properties of one or more control signals transmitted to the pixel 82 and/or any other suitable component of the display 18 to affect the perceived brightness of the pixel 82. In addition, the controller 84 may change the pixel parameter measured based at least in part on the filtered correction value.

In some embodiments, after applying the correction, at block 168, the controller 84 may transmit an indication that the correction has been applied. This indication may be transmitted to a sub-component responsible for restarting the error measurement, or may initiate a new error measurement when suitable during display 18 operation.

In addition, after applying the correction, at block 170, the controller 84 may repeat the method 140 to determine a next compensated error, E(t+1), using additional test data or signals. The controller 84 may continue to repeat method 140 and method 160 until a compensated error converges to a constant value, or substantially constant value. In some embodiments, the determination of the next compensated error and the subsequent pixel parameter correction may occur on a periodic basis (e.g., a predetermined time interval) and/or in response to an indication transmitted from a monitoring component, an input structure 20, or the like. In this way, the controller 84 may self-manage the correction process or may perform the correction and/or calibration process in response to received control signals.

Figure 11:
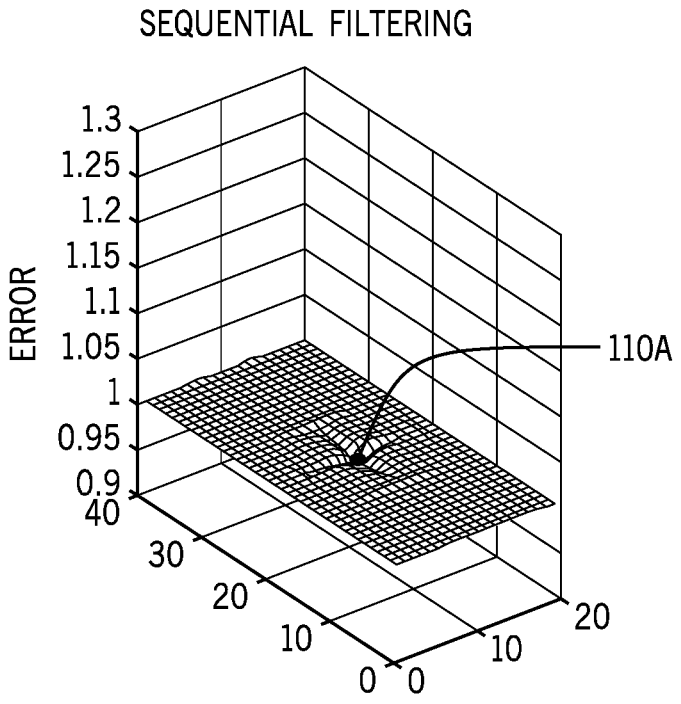
FIG. 11 is the graph of the simulation results of FIG. 6B that depict the spatial crosstalk during non-uniformity correction operations, in accordance with an embodiment.

To highlight effects of using a spatially leaking temporal integrator, FIG. 11 is the graph of FIG. 6B of the simulation results that depict spatial crosstalk during error correction operations. To briefly reiterate, a point 110A on the graph corresponds to a location of a simulated pixel parameter measurement (e.g., x- and y-axis correspond to a location mapping of a display 18) and a particular amount of measurement error associated with that pixel parameter sensing operations for a pixel 82. The amount of measurement error decreases and oscillates away from the point 110A, such as towards the origin, because the influence of the pixel 82 being measured on adjacent pixels 82 being driven decreases away from the pixel 82. To facilitate mitigation of these influences, a process to minimize spatial crosstalk is caused by performing the spatial filtering before the temporal integration may be useful in mitigating the measurement error propagation.

Figure 12:
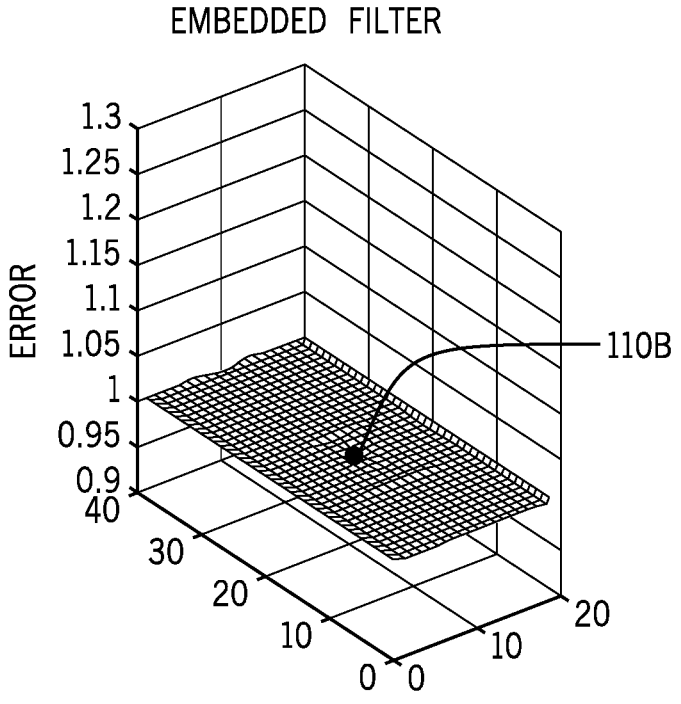
FIG. 12 is a graph of simulation results depicting spatial crosstalk associated with non-uniformity correction operations using a spatially leaking temporal integrator, in accordance with an embodiment.

FIG. 12 is a graph of simulation results depicting spatial crosstalk associated with error correction operations using a spatially leaking temporal integrator. A point 110B, corresponding to the same pixel parameter measurement pixel 82 location as the point 110A, also corresponds to a particular amount of measurement error associated with the pixel parameter sensing for the pixel 82. While, the amount of measurement error decreases away from the point 110B, similar to FIG. 10A, the amount of measurement error that propagates to nearby pixels 82 is less from the point 110B than from the point 110A. In this way, while the influence of the pixel 82 is no different from the pixel 82 of FIG. 10A, the influence of the pixel 82 may be better mitigated through error correction operations that use a spatially leaking temporal integrator. These error correction operations that correct measurement errors using at least in part an embedded spatial filter facilitate reducing the effects of spatial crosstalk on the non-uniformity correction operations.

In some embodiments, a pixel parameter associated with more than one pixel 82 is measured via sensing locations (e.g., sensing location 91). In this way, a pixel parameter may be analyzed on a grouping or subset of pixels 82 basis to reduce an amount of bandwidth or an amount of processing resources used to determine a compensated error value. For example, less processing resources may be used for determining a compensated error value for ten pixels 82 than determining ten compensated error values for ten pixels 82. Consolidating the analysis of measurement error based on groupings of pixels 82 may be suitable if the groupings of pixels 82 do not have significant variation between characteristics of the pixels 82, for example, a group of pixels 82 may have similar positions on a display 18, emit similar levels of light, operate in similar thermal conditions, or the like. Groups of pixels 82 including groupings based at least in part on rows, columns, or similar portions of the display 18. These groupings of pixels 82 to form a sensing location 91 may include any suitable number of pixels 82 organized in any suitable geometry, including and not limited to one pixel 82, multiple pixels 82 associated with a same row of pixels 82, multiple pixels 82 associated with a same column of pixels 82, multiple pixels 82 corresponding to a region or area of pixels 82 on a display 18, or the like.

Thus, the technical effects of the present disclosure include improvements to compensation techniques of electronic displays for correcting non-uniform pixel properties caused by non-uniform errors introduced into pixel parameters during transmission or operation of the pixel by a controller. The compensation techniques may include determining a measurement error through error correction operations that include a spatially leaking temporal integrator. These techniques describe performing spatial filtering based on a residual error inputted to the temporal integrator, instead of performing spatial filtering before the residual error undergoes temporal integration. These techniques describe an improved manner to detect and correct for measurement errors because through using the spatially leaking temporal integrator compensated error values converge faster than when spatial filtering and temporal integration are sequentially performed.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system, comprising:

an electronic display panel comprising a plurality of pixels configured to depict image data; and processing circuitry configured to:

receive a first error value representative of a first difference between a first electrical signal measured at a first pixel of the plurality of pixels and an expected electrical signal for the first pixel, wherein the first electrical signal is based on a test signal transmitted to the first pixel, and wherein the expected electrical signal corresponds to an expected response of the first pixel based on the test signal;

temporally and spatially filter the first error value to generate a first compensated error value; and temporally and spatially filter the first error value based on the first compensated error value to generate a second compensated error value at least in part by:

removing the first compensated error value from the first error value to generate a first residual error value;

combining the first residual error value with the first compensated error value to generate a second residual error value;

temporally filtering the second residual error value to generate a second temporally filtered error value; and spatially filtering the second temporally filtered error value to generate the second compensated error value, wherein the second compensated error value is applied to one or more electrical signals employed by a pixel circuit configured to display a portion of the image data, and wherein the second compensated error value is configured to filter one or more effects of spatial crosstalk between one or more pixels adjacent to the first pixel.

2. The system of claim 1, wherein the processing circuitry is configured to generate a first compensated error value by:

temporally filtering the first error value to generate a first temporally filtered error value; and spatially filtering the first temporally filtered error value to generate the first compensated error value.

3. The system of claim 2, wherein the first electrical signal and the expected electrical signal correspond to a driving voltage or a driving current of the first pixel generated in response to the test signal.

4. The system of claim 1, wherein the first error value corresponds to a subset of the plurality of pixels disposed within a spatial region of the electronic display panel in addition to the first pixel.

5. The system of claim 1, wherein the first error value corresponds to a subset of the plurality of pixels associated with a particular color channel.

6. The system of claim 1, wherein the second compensated error value is configured to compensate for a threshold voltage of the first pixel.

7. The system of claim 1, wherein the processing circuitry is configured to iteratively temporally and spatially filter the first error value until the second compensated error value converges to a constant value.

8. The system of claim 7, wherein the constant value is zero.

9. A method, comprising:

receiving, via circuitry, a first error value representative of a first difference between a first electrical signal measured at a first pixel of a plurality of pixels and an expected electrical signal for the first pixel, wherein the first electrical signal is based on a test signal transmitted to the first pixel, and wherein the expected electrical signal corresponds to an expected response of the first pixel based on the test signal;

temporally and spatially filtering, via the circuitry, the first error value to generate a first compensated error value; and temporally and spatially filtering, via the circuitry, the first error value based on the first compensated error value to generate a second compensated error value at least in part by:

subtracting, via the circuitry, the first compensated error value from the first error value to generate a first residual error value;

combining, via the circuitry, the first residual error value with the first compensated error value to generate a second residual error value;

temporally filtering, via the circuitry, the second residual error value to generate a second temporally filtered error value; and spatially filtering, via the circuitry, the second temporally filtered error value to generate the second compensated error value, wherein the second compensated error value is applied to one or more electrical signals employed by a pixel circuit configured to display a portion of image data, and wherein the second compensated error value is configured to filter one or more effects of spatial crosstalk between one or more pixels adjacent to the first pixel.

10. The method of claim 9, comprising:

temporally filtering, via the circuitry, the first error value to generate a first temporally filtered error value; and spatially filtering, via the circuitry, the first temporally filtered error value to generate the first compensated error value.

11. The method of claim 9, wherein the second compensated error value comprises a converged compensated error value representative of a plurality of iterations of temporal and spatial filtering the first error value based on a respective compensated error value.

12. The method of claim 9, comprising:

determining, via the circuitry, an adjustment to the one or more electrical signals based on the second compensated error value; and adjusting, via the circuitry, the one or more electrical signals based on the adjustment.

13. A display driver, configured to:

receive a first error value representative of a first difference between a first electrical signal measured at a first pixel of a plurality of pixels and an expected electrical signal for the first pixel, wherein the first electrical signal is based on a test signal transmitted to the first pixel, and wherein the expected electrical signal corresponds to an expected response of the first pixel based on the test signal;

temporally and spatially filter the first error value to generate a first compensated error value; and temporally and spatially filter the first error value based on the first compensated error value to generate a second compensated error value at least in part by:

removing the first compensated error value from the first error value to generate a first residual error value;

combining the first residual error value with the first compensated error value to generate a second residual error value; and temporally filtering the second residual error value to generate a second temporally filtered error value; and spatially filter the second temporally filtered error value to generate the second compensated error value, wherein the second compensated error value is applied to one or more electrical signals employed by a pixel circuit configured to display a portion of image data, and wherein the second compensated error value is configured to filter one or more effects of spatial crosstalk between one or more pixels adjacent to the first pixel.

14. The display driver of claim 13, configured to:

receive the second compensated error value; and determine an adjustment to be applied to the one or more electrical signals based at least in part on the second compensated error value.

15. The display driver of claim 13, wherein the second compensated error value comprises a converged compensated error value.

16. The display driver of claim 15, wherein the converged compensated error value is zero.

* * * * *